United States Patent [19]

Howard

[11] Patent Number: 4,927,048

[45] Date of Patent: May 22, 1990

[54] BEVERAGE CAN HAVING A SANITARY COVER

[76] Inventor: Roy T. Howard, 2750 Plumas St, #300, Reno, Nev. 89509

[21] Appl. No.: 851,544

[22] Filed: Apr. 14, 1986

[51] Int. Cl.[5] ..... B65D 51/20

[52] U.S. Cl. ..... 220/90.2; 215/232; 220/214; 220/257; 220/279

[58] Field of Search ..... 220/90.2, 90.4, 90.6, 220/214, 256, 257, 258, 279; 215/232

[56] References Cited

U.S. PATENT DOCUMENTS

| | | | |
|---|---|---|---|
| 3,391,847 | 7/1968 | Christine | 220/257 |
| 3,438,533 | 4/1969 | Hanisch | 220/90.6 |
| 4,209,126 | 6/1980 | Elias | 215/232 |
| 4,408,697 | 10/1983 | Yoshikawa | 220/279 |
| 4,438,850 | 3/1984 | Kahn | 220/257 |

FOREIGN PATENT DOCUMENTS

| | | | |
|---|---|---|---|
| 130295 | 10/1979 | Japan | 220/258 |
| 474420 | 8/1969 | Switzerland | 220/257 |
| 2155897 | 10/1985 | United Kingdom | 220/214 |

*Primary Examiner*—George E. Lowrance
*Attorney, Agent, or Firm*—Norman B. Rainer

[57] ABSTRACT

A protective covering for the closure lid of a beverage can has a tear-away access strip which exposes the pull-tab and pouring aperture. The access strip remains attached to the protective covering even after tearing to expose the pouring aperture. The covering is adhered to the can in a closely conforming manner so as not to interfere with the normal 6-pack clustering and stacking of the cans.

2 Claims, 2 Drawing Sheets

BEVERAGE CAN HAVING A SANITARY COVER

BACKGROUND OF THE INVENTION

The present invention relates to an improved sanitary cover for the top of beverage cans provided with pull-type opening devices.

Metal cans as presently utilized for the packaging of beverages such as beer, carbonated drinks, and fruit and vegetable juices are generally comprised of a circular cylindrical sidewall, a bottom closure panel integral with said sidewall, and a top closure lid attached by a rolling and crimping technique to the upper extremity of the sidewall and thereby forming an upwardly and outwardly protruding perimeter bead or rim. Pull-type opening devices located within the lid are designed to create a pouring aperture. In preferred embodiments, the opening device is designed to remain a part of the can, thereby minimizing the littering problem caused when pull tabs are carelessly discarded.

In the course of the storage and shipment of canned beverages, the lid is susceptible to contamination with dirt, remains of liquid spills, animal residues, toxic inorganic substances, and pathogenic micro-organisms such as bacteria and viruses. Such hygienically undesirable substances generally become concentrated within a depressed trough adjacent the rim produced by the crimping operation which attaches the lid to the sidewall. Proper cleaning of the lid prior to opening of the can is often overlooked. Even so, cleaning of the trough region is extremely difficult, and to make matters worse, the beverage during pouring will enter the trough and wash contaminents therefrom into the mainstream of the beverage. Accordingly, whether the consumer drinks the beverage by direct mouth contact with the lid or after pouring from the can, he is likely to ingest the aforementioned contaminants.

Prior efforts to overcome the aforementioned unsanitary aspects of beverage cans have involved protective coverings which are either expensive, difficult to use, separable from the can, and thereby constituting a litter problem, or not compatible with packaging of the cans in six-pak clusters and the stacking thereof.

It is therefore an object of the present invention to provide a sanitary protective covering for the top of a beverage-filled can having an aperture-generating pull tab and raised perimeter rim.

It is another object of this invention to provide a can having a sanitary covering as in the foregoing object.

It is a further object of the present invention to provide a covering of the aforesaid nature which is inexpensive and easily manipulated to permit sanitary access to the beverage.

It is yet another object of this invention to provide a covering of the aforesaid nature which remains attached to the can after it has served its intended purpose.

It is a still further object of the invention to provide a covering of the aforesaid nature which allows stacking of said cans and packaging of the cans in six-pack clusters.

These objects and other objects and advantages of the invention will be apparent from the following description.

SUMMARY OF THE INVENTION

The above and other beneficial objects and advantages are accomplished in accordance with the present invention by a protective covering for a beverage can having a top closure panel having a pull tab and raised perimeter rim, said covering comprising an integral aluminum foil of substantially circular shape which covers said closure panel and rim in adhesive attachment therewith, and a tear-away access strip constituting a portion of said foil in aligned disposition above the pouring aperture of said closure panel and adapted to remain attached to said foil.

In preferred embodiments, the aluminum foil is plastic-coated on the underside in a manner which permits easy and controlled tearing of the foil at the boundaries of the access strip, yet prevents complete separation of the access strip from the remainder of the foil.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
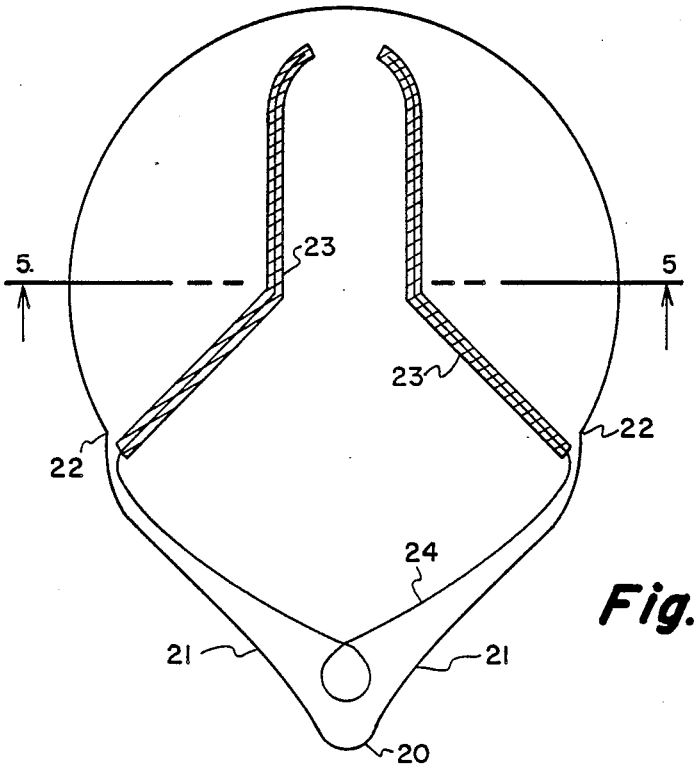
FIG. 1 is a plan view of the underside of an embodiment of the protective cover of this invention prior to installation onto a can.
Figure 2:
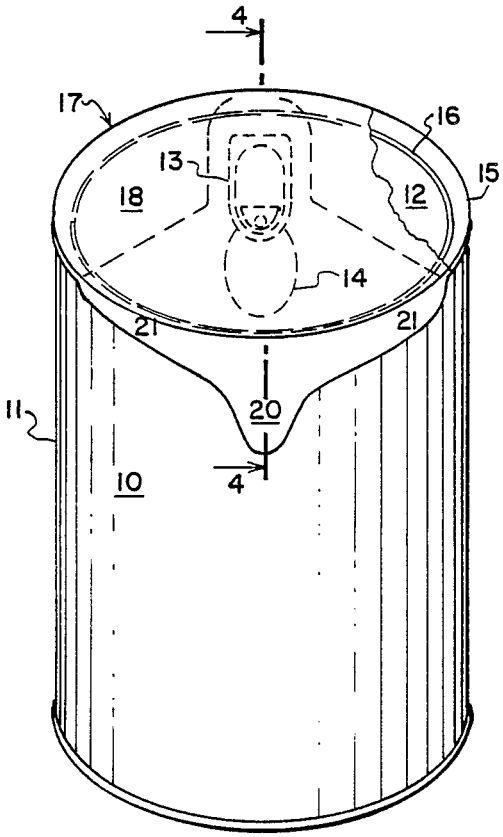
FIG. 2 is a perspective view of a can equipped with the protective cover of FIG. 1.
Figure 3:
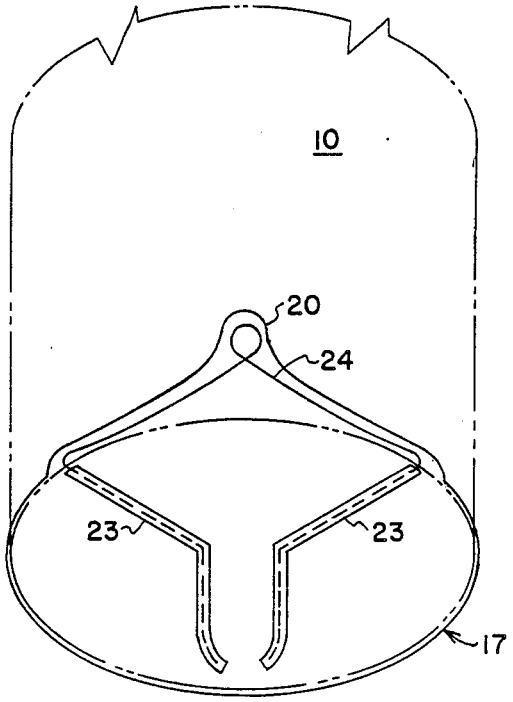
FIG. 3 is a perspective view showing the inverted underside of the cover in its installed position upon a can.
Figure 4:
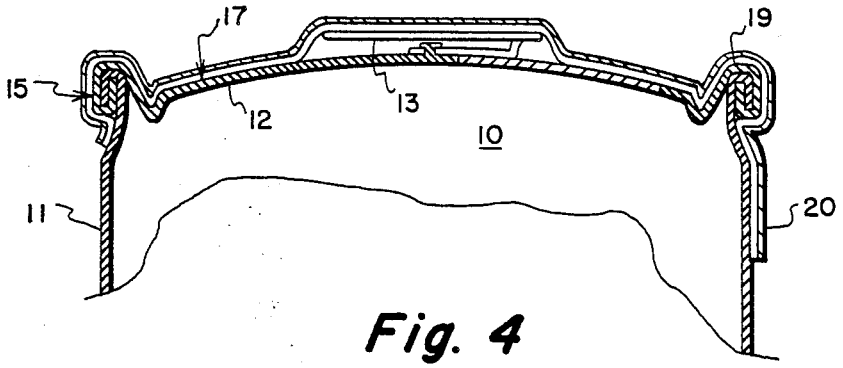
FIG. 4 is an enlarged sectional view taken along the line 4—4 of FIG. 2.
Figure 5:
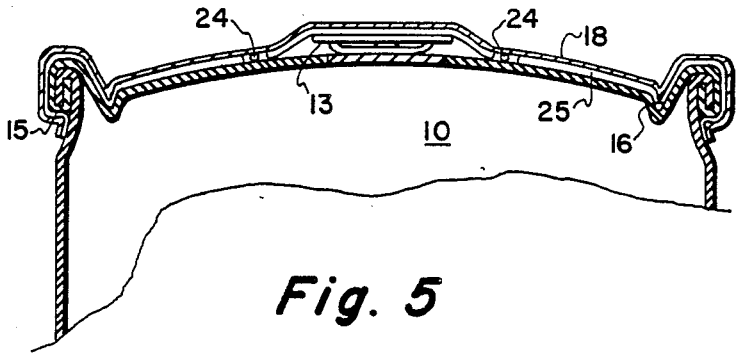
FIG. 5 is an enlarged sectional view taken along the line 5—5 of FIG. 1.

Referring to the drawing, an embodiment of beverage-containing can 10 useful in the practice of this invention is shown comprised of cylindrical sidewall 11, top closure lid 12 having lift-up tab 13 adapted to form a pouring aperture 14, and upraised perimeter bead 15 adjacent trough 16. Beverage cans of other conventional designs may also be effectively utilized in the practice of this invention, including cans wherein the closure lid 12 is of slightly smaller diameter than sidewall 11.

A protective covering 17 comprised of an integral aluminum foil 18 of substantially circular shape covers said closure panel and bead and is adhesively attached to the outer surface 19 of the bead. A pulling tab 20 is pendantly disposed as a continuous integral extension of foil 18 in alignment with pouring aperture 14. The lifting tab is provided with two symmetrically opposed ears 21 which merge with the perimeter of the foil at merge sites 22.

The entire underside of the aluminum foil, with the exception of tearing pathways 23 extending from merge sites 22 and around lift-up tab 13, is coated with a tear-resistant polymeric material 25. Tear-enhancing means in the form of tear string 24 may be adhered beneath the foil of pathways 23. In alternative embodiments, the tearing pathways may be formed by the cutting or other cohesion-destroying treatment of an otherwise continuous tear-resistant coating 25 along an appropriate path.

By virtue of the aforesaid construction, lifting of the pulling tab enables string 24 to initiate a tear in the aluminum foil which is easily propagated along foil pathways 23. Upon reaching the extremities of said pathways, the torn portion of the foil remains attached to the portion of the foil remaining attached to the can. The torn portion exposes the lift-up 13 of the top closure of the can thereby facilitating manipulation thereof to form pouring aperture 14.

As shown in the drawing, covering 17 is designed to conform to the contour of the lid and bead of the can. Because of such feature, the sanitary cover of this invention does not impair the ability of the can to be packaged in six-pack clusters, and to be vertically stacked. The covering is preferably applied to the can by adhesives such as those of the contact type and hot-melt type, said adhesives being amenable to application by high speed methods. The adhesive bonding is however weaker on the bead between merge sites 22, thereby enabling tab 20 to be lifted and peeled along pathways 23. In certain embodiments, the polymeric coating 25 may also serve as a hot melt adhesive, whereby strength of bonding at given sites of the lid is determined by the application of heat and pressure.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A protective covering for a beverage can having a top closure panel having a pouring aperture sealed by a pull-tab and a raised perimeter rim, said covering comprising an integral aluminum foil of substantially circular periphery having a tear-resistant plastic coating and configured to cover said closure panel and rim in adhesive attachment therewith, and a tear-away access strip constituting a portion of said foil in aligned disposition above said pouring aperture, said access strip being defined by pathways wherein said tear-resistant plastic coating is not functionally present, said pathways terminating in extremities within said tear-resistant plastic coating, thereby permitting easy and controlled tearing of the foil at the boundaries of the access strip, yet preventing complete separation of the access strip from the remainder of the foil.

2. The covering of claim 1 wherein tear-enhancing means are disposed beneath the foil along said pathways.

* * * * *